US009941625B2

(12) United States Patent
Boemmel et al.

(10) Patent No.: US 9,941,625 B2
(45) Date of Patent: Apr. 10, 2018

(54) SOCKET SHAPED HOUSING, CONNECTOR, AND CONNECTOR ARRANGEMENT WITH CABLE SUPPORT

(71) Applicant: Tyco Electronics AMP GmbH, Bensheim (DE)

(72) Inventors: Christian Boemmel, Langen (DE); Rolf Jetter, Darmstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 137 days.

(21) Appl. No.: 14/519,922

(22) Filed: Oct. 21, 2014

(65) Prior Publication Data

US 2015/0111405 A1 Apr. 23, 2015

(30) Foreign Application Priority Data

Oct. 21, 2013 (DE) ..... 10 2013 221 339

(51) Int. Cl.

| | |
|---|---|
| ***H01R 13/58*** | (2006.01) |
| ***H01R 13/436*** | (2006.01) |
| ***H01R 13/533*** | (2006.01) |
| ***H01R 13/516*** | (2006.01) |
| ***H01R 13/426*** | (2006.01) |

(52) U.S. Cl.

CPC ..... *H01R 13/533* (2013.01); *H01R 13/426* (2013.01); *H01R 13/516* (2013.01); *H01R 13/582* (2013.01); *H01R 13/5812* (2013.01); *H01R 13/4368* (2013.01); *H01R 13/5825* (2013.01)

(58) Field of Classification Search

CPC .. H01R 13/582; H01R 13/5825; H01R 13/74; H01R 13/6271; H01R 13/4368

USPC ..... 439/752, 680, 460, 686, 677; 43/562, 43/557, 571, 55, 350, 569, 578

See application file for complete search history.

(56) References Cited

U.S. PATENT DOCUMENTS

| | | | | |
|---|---|---|---|---|
| 3,873,172 A * | 3/1975 | Paullus | ..... | H01R 12/778 439/498 |
| 5,720,629 A * | 2/1998 | Self, Jr. | ..... | H01R 13/5219 439/274 |
| 6,994,590 B2 * | 2/2006 | Nishida | ..... | H01R 13/5219 439/271 |
| 8,747,145 B2 | 6/2014 | Gossen | | |
| 2012/0094525 A1 * | 4/2012 | Maranto | ..... | H01R 13/5829 439/460 |

FOREIGN PATENT DOCUMENTS

| | | |
|---|---|---|
| DE | 102012102212 A1 | 9/2013 |
| WO | 2011003914 A1 | 1/2011 |

* cited by examiner

*Primary Examiner* — Renee Luebke
*Assistant Examiner* — Paul Baillargeon
(74) *Attorney, Agent, or Firm* — Barley Snyder

(57) ABSTRACT

An electrical connector assembly is disclosed having a socket-shaped housing with a cable receiving end and an opposing support facing end, a plug connector receiving space, and a flange positioned on the support facing end. A cable collar is positioned in the plug connector receiving space and supported by the housing, and has at least one cable receiving space. At least one cable is secured in the cable receiving space.

11 Claims, 4 Drawing Sheets

SOCKET SHAPED HOUSING, CONNECTOR, AND CONNECTOR ARRANGEMENT WITH CABLE SUPPORT

CROSS-REFERENCE TO RELATED APPLICATION

This application claims priority under 35 U.S.C. § 119 (a)-(d) to German Patent Application DE 10 2013 221 339.5, filed on Oct. 21, 2013.

FIELD OF THE INVENTION

The invention is generally related to an electrical connector, and more specifically to a plug and socket electrical connector.

BACKGROUND

Socket-shaped housings and complementary plug connectors are well known, and are used in a wide variety of applications, ranging from consoles of control cabinets to body components in automobile construction. The housings receive a standardized plug connector based on industry or company standards required for the desired purpose, such as for power and/or data transfer. The plug connector is held in place by the housing, which is in turn, attached to a support structure. The housing and the plug connector, as a unit, are used as a socket by connecting together with a mating plug having a complementary structure to the plug connector.

In many applications, the housing, plug connector, and cable are exposed to operational vibrations, which result in a relative movement between the plug connector and the mating plug. This movement often results in wear to electrical contacts positioned in the plug connector over time, in the form of friction, oxidation, or rubbing through.

Conventional methods of reducing vibrationally induced wear include integrating a cable collar in or on the connector, as shown for example in German Patent Application No. 10 2009 032 393 A1, European Patent Application No. 2 228 870 B1, and German Patent Application No. 10 2012 102 212 A1. However, the integrated cable collar adds additional length and bulk and does not always allow for universal application without requiring connector modification.

There is a need for electrical connectors that have reduced vibrational wear on the electrical contacts, while allowing for universal application.

SUMMARY

An electrical connector assembly has a socket-shaped housing with a cable receiving end and an opposing support facing end, a plug connector receiving space, and a flange positioned on the support facing end. A cable collar is positioned in the plug connector receiving space and supported by the housing, and has at least one cable receiving space. At least one cable is secured in the cable receiving space.

BRIEF DESCRIPTION OF THE DRAWINGS

The invention will be described by way of example, with reference to the accompanying Figures, of which.

DETAILED DESCRIPTION OF THE EMBODIMENT(S)

Figure 2:
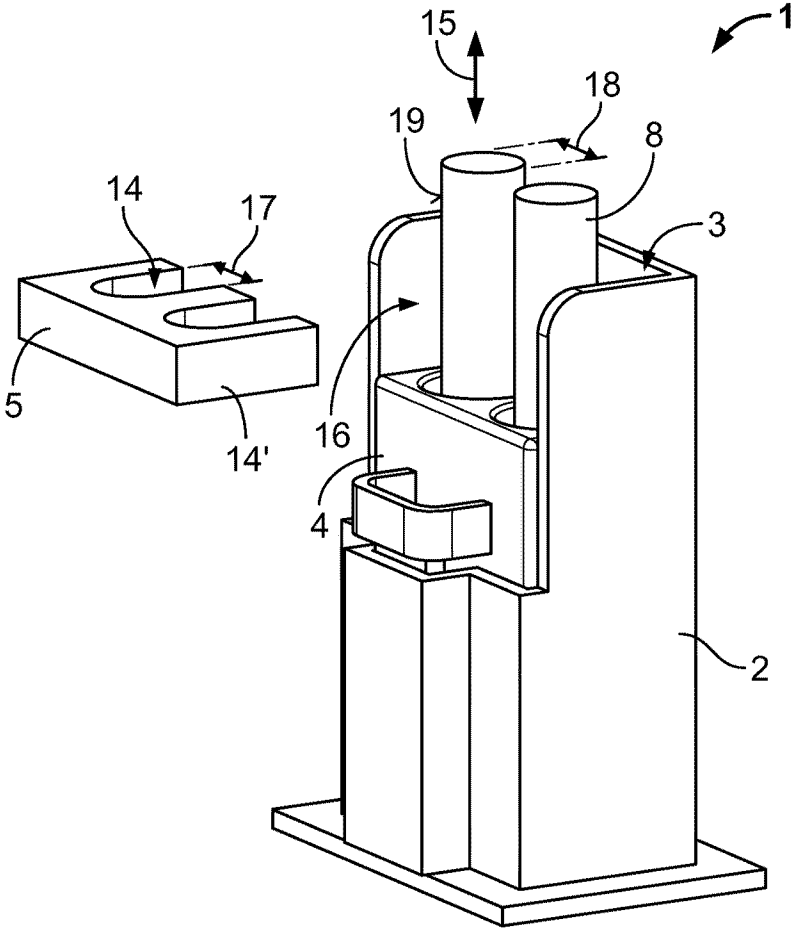
FIG. 2 is a perspective view of the connector assembly prior to the insertion of the plug connector and cable collar into the housing.

A connector assembly 1 has a housing 2 with a plug connector receiving space 3, in which a plug connector 4 and a cable collar 5 are received.

The housing 2 is socket-shaped and fastened to a support 6 (only shown schematically), such a console, support housing, printed circuit board, or the like. Attachment to the support 6 is through a flange 7 positioned on a support facing end of the housing 2. The connector assembly 1 forms a socket defined by the plug connector receiving space 3 into which the plug connector 4 can be inserted.

The plug connector 4 is standardized in accordance with industry or company standards. The plug connector 4 is connected to at least one cable 8 and has at least one contact element (not shown in FIG. 1) conductively connected through a lead 9 to each cable 8. In the embodiment shown in FIG. 1, two cables 8 are connected to the plug connector 4, however, one of ordinary skill in the art would appreciate that one or three or more cables 8 can be connected to the plug connector 4.

The cable collar 5 is positioned on a cable receiving end 10 of the housing 2 in the plug connector receiving space 3. In an embodiment, the plug connector receiving space 3 is open on the cable receiving end 10 of the housing 2. In another embodiment the plug connector receiving space 3 is also open on a housing 2 side perpendicular to the cable receiving end 10 to form a lateral opening 16, where the open cable receiving end and lateral opening 16 form a notch-like opening. On an opposing attachment end 11, the plug connector receiving space 3 may be circumferentially closed to enclose the plug connector 4.

On the cable receiving end 10, the plug connector receiving space 3 is defined by three side walls 12 forming a substantial U-shape.

The plug connector 4 is inserted into the housing 2 in an assembled state that includes the attached cable 8 and contact elements (not shown), and locks in place by engaging a lock 13.

The cable collar 5 includes a cable receiving space 14, where at least one cable 8 is positioned and clamped, such that movement of the cable 8 is restricted in degrees of freedom. The cable collar 5 is positioned in the plug connector receiving space 3 on the cable receiving end 10, and substantially occupies the U-shaped portion of the plug connector receiving space 3.

Figure 1:
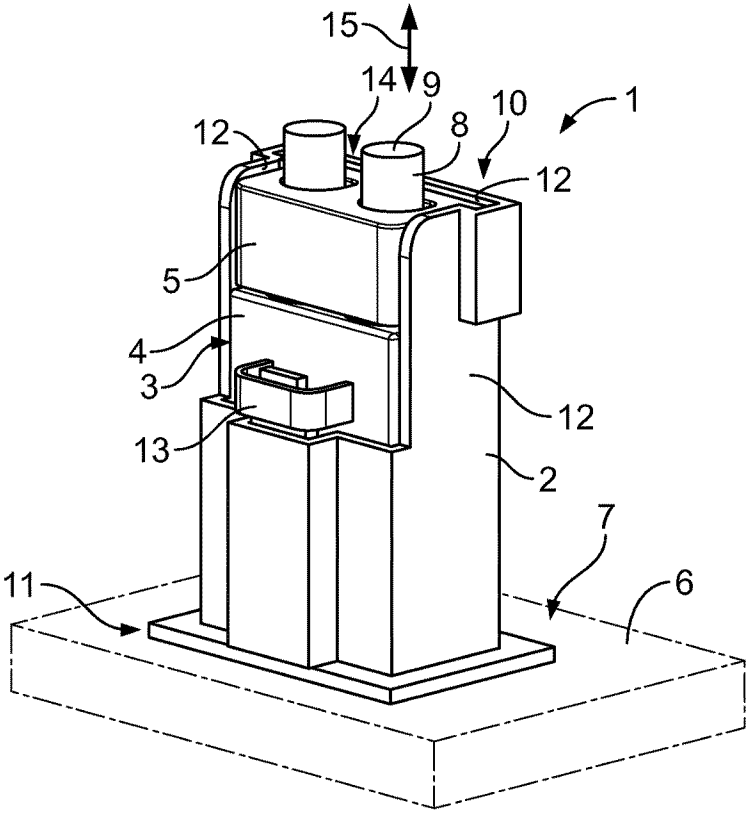
FIG. 1 is a perspective view of a connector assembly having a housing, cable collar, and plug connector.

In the embodiment shown in FIG. 1, the cable collar 5, as seen in the insertion direction 15 of the cable 8, is positioned in the plug connector receiving space 3, between the cable receiving end 10 of the housing 2 and an inserted plug connector 4.

The cable collar 5 is directly supported by the housing 2, such that the cable collar 5 prevents relative movement between the cable 8 and the housing 2. Thus, the cable collar 5 absorbs vibrations that would otherwise be transferred through the cable 8 to the plug connector 4, preventing relative movement through a mating plug (not shown). Such movement is undesirable because it may increase wear on the contacts elements of the plug connector 4 and the mating plug. The position of the plug connector 4 relative to the cable collar 5 and the housing 2, isolates the plug connector 4 from vibrations along the cable 8, because the cable collar 5 and housing 2 absorb the vibrations before the vibrations can be transmitted to the plug connector 4.

In the discussion of the exemplary embodiments below, elements equivalent in structure and/or function will be given the same reference numerals as in the exemplary embodiment of FIG. 1. The description is therefore limited to the respective differences between the exemplary embodiments unless otherwise stated.

In the embodiment of FIG. 2, the cable collar 5 has at least one cable receiving space 14 of which is open laterally on one side of the cable collar 5, such that it can be moved laterally, perpendicular to the insertion direction 15 of the cable 8. In an embodiment, the number of cable receiving spaces 14 may be equal to or greater than the number of cables 8. The cable 8 is positionable in the cable receiving space 14 by lateral insertion of the cable 8 into the cable receiving space 14 through the open side of the cable collar 5.

The cable collar 5 can be inserted from the cable receiving end 10 and/or the lateral opening 16 into the plug connector receiving space 3 of the housing 2.

A width 17 of the cable receiving space 14 is less than an external diameter 18 of the cable 8 when the cable collar 5 is positioned in the plug connector receiving space 3. By undersizing the cable receiving space 14, an external insulation layer 19 of the cable 8, which is generally resilient, is compressed such that the cable 8 is securely clamped in the cable receiving space 14. Additionally, the width of the cable collar 5 may be larger than the width of the plug connector receiving space 3 along a direction perpendicular to the insertion direction 15. When the cable collar 5 is inserted into the plug connector receiving space 3, the cable collar 5 is compressed such that the width of the cable receiving space 14 is elastically reduced.

In another embodiment, the width of the cable collar 5 may be approximately equal to or less than the width of the plug connector receiving space 3, and the width of the cable receiving space 14 may be less than the external diameter of the cable 8. When the cable 8 is inserted into the cable receiving space 14, the width cable receiving space 14 is elastically expanded by the larger-diameter cable 8, resulting in a subsequent elastic increase in the width of the cable collar 5. Therefore, the cable 8 is elastically retained in the cable receiving space 3, and the elastic expansion of the width of the cable collar 5 results in the cable collar 5 exerting a retention force against the sides of the plug connector receiving space 3 to press-fit the cable collar 5 therein.

Figure 3:
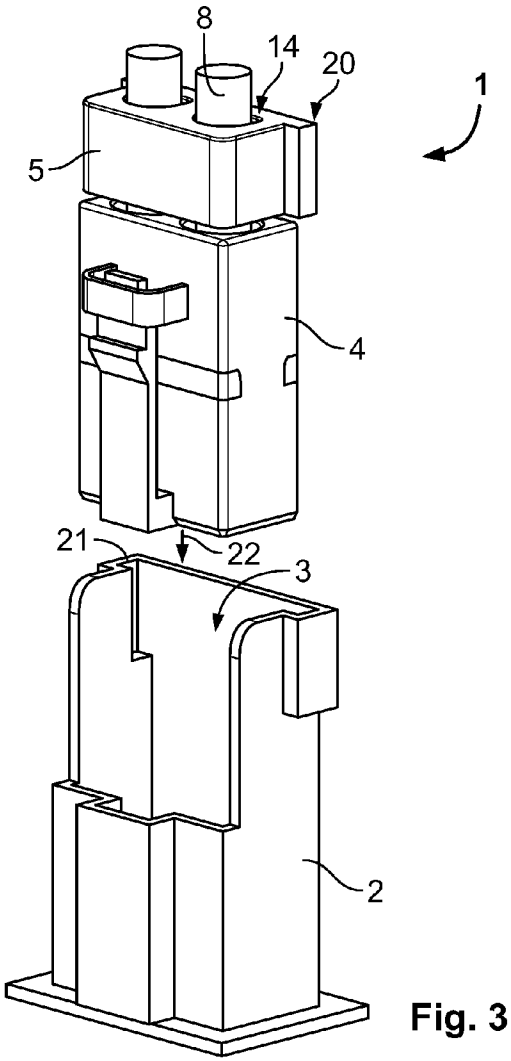
FIG. 3 is an exploded view of the connector assembly with the plug connector and cable collar prior to insertion into the housing.

In the embodiment of FIG. 3, the cable receiving space 14 is enclosed on all sides to form a hole-shape, thus completely enclosing the cable 8. One end of the cable 8 is positioned through the cable receiving space 14 to mount the cable collar 5 on the cable 8. Together with the plug connector 4, the cable collar 5 can then be inserted into the plug connector receiving space 3 of the housing 2. Alternatively, the plug connector 4 can first be inserted into the housing 2, and the cable collar 5 can then be moved along the at least one cable 8 into the plug connector receiving space 3.

In the embodiment of FIG. 3, the cable collar 5 may also include a first guide member 20. The housing 2 may have a second guide member 21 that complements the first guide member 20. The first and second guide members 20, 21 together form a linear guide to guide the cable collar 5 into the plug connector receiving space 3 along the insertion direction 15. In an embodiment, the first and second guide members 20, 21 permit the width of the cable collar 5 to be equal to or less than the width of the width of the plug receiving space 3, resulting in the cable collar 5 fitting with little, or no play in the housing 2. In another embodiment, the first and second guide members 20, 21 may have a press fit.

In an embodiment, the first and second guide members 20, 21 are tongue and groove members that allows for movement of the cable collar 5 along the insertion direction 22 of the plug connector 4 into the housing 2, while preventing movement in other directions.

In an embodiment, the first and second guide members 20, 21 include a locking member (not shown) with which the cable collar 5 locks into place in the plug connector receiving space 3.

In an embodiment, the cable collar 5 of FIG. 2 includes a pair of collar arms 14' that extend along opposing sides of the cable collar 5. The first guide member 20, shown in FIG. 3, may be positioned at one end of collar arms 14' (not shown). When the cable collar 5 is inserted into the plug connector receiving space 3, the first and second guide members 20, 21 engage with one another, causing the collar arms 14' to be deflected towards one another, reducing the width 17 of the cable receiving space 14, and thus clamping an inserted cable 8.

Figure 4:
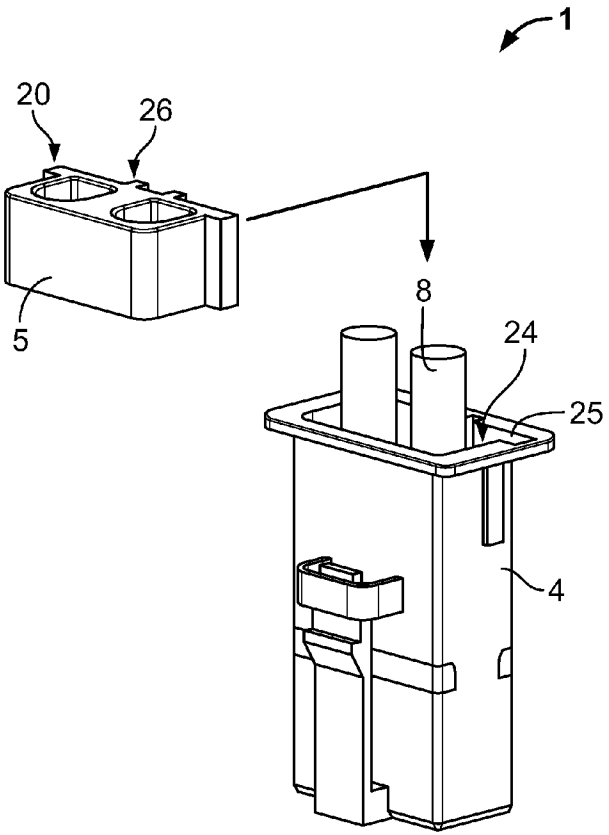
FIG. 4 is a schematic representation of a connector assembly with a cable collar.
Figure 5:
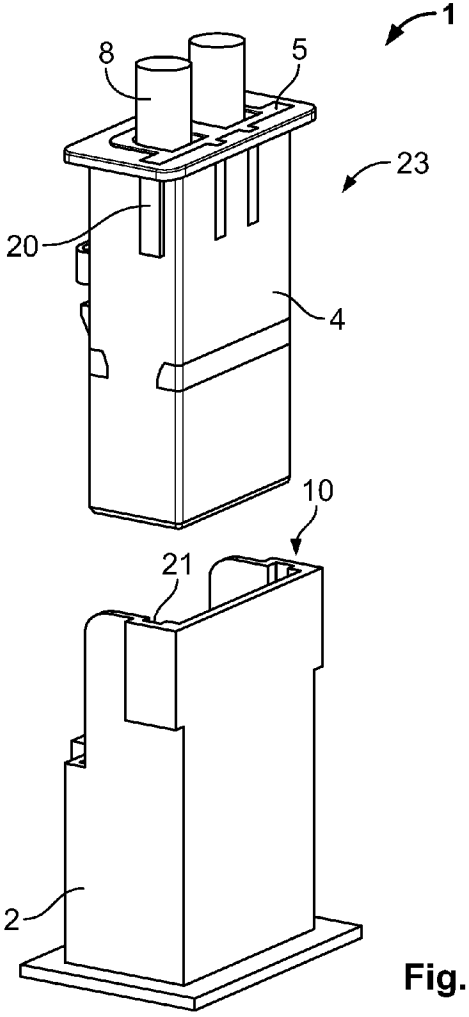
FIG. 5 is a perspective view of the plug connector and the cable collar of FIG. 4 with housing.

In embodiments of FIGS. 4 and 5, the cable collar 5 is pre-mounted on the plug connector 4, such that the two form a plug connector unit 23. The plug connector 4 has a cable collar receiving space (not labelled) accessible through a cable receiving opening 24 positioned on a cable receiving end of the plug connector 4. The cable collar 5 is positioned in the cable collar receiving space of the plug connector 4, through the cable receiving opening 24 to close the cable-side opening 24. As seen in FIGS. 4, the cable collar 5 may also include at least one first guide member 20, supported in the plug connector receiving space 3 and/or engageable with the second guide member 21 of the housing 2, as shown in FIG. 5.

The plug connector unit's 23 first guide member 20 protrudes from an outer surface of the plug connector 4, allowing engagement of the first guide member 20 of the plug connector 4 with the second guide member 21 of the housing 2.

In an embodiment of FIGS. 4 and 5, the plug connector 4 includes at least one third guide member 25 that engages with the first guide member 20. The cable collar 5 includes a fourth guide member 26 that may also engage with the third guide member 25 to secure the cable collar 5 on the plug connector 4. The guide members 20, 25, and/or 26 may form a linear guide for the cable collar 5, along which the cable collar 5 is at least partially guided movably into the plug connector 4 along the insertion direction 5 of the cable 8. The guide members 20, 25, and/or 26 may additionally allow the cable collar 5 to lock in place in the plug connector 4.

In the embodiment of FIGS. 4 and 5, the cable 8 is attached to the housing 2 through the cable collar 5 although the cable collar 5 is on the plug connector 4. Simultaneously, the cable collar 5 retains the plug connector 4 on the cable receiving end 10 of the housing both relative to the cable 8 and to the housing 2, resulting in the cable collar 5 forming a rigid connection between the housing 2 and the plug connector 4.

Figure 6:
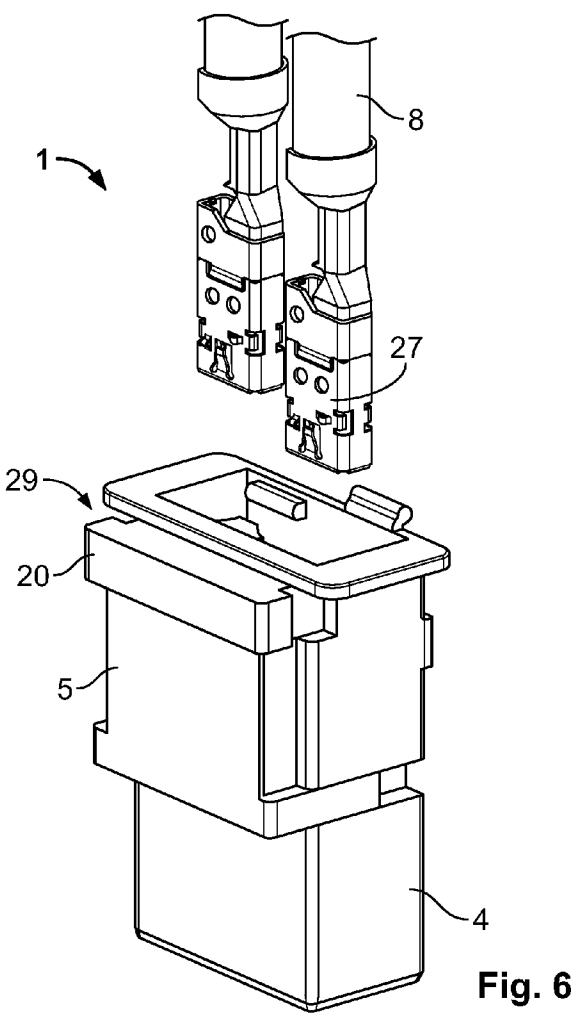
FIG. 6 is an exploded view of a plug connector with a cable collar, cables, and contact elements.
Figure 8:
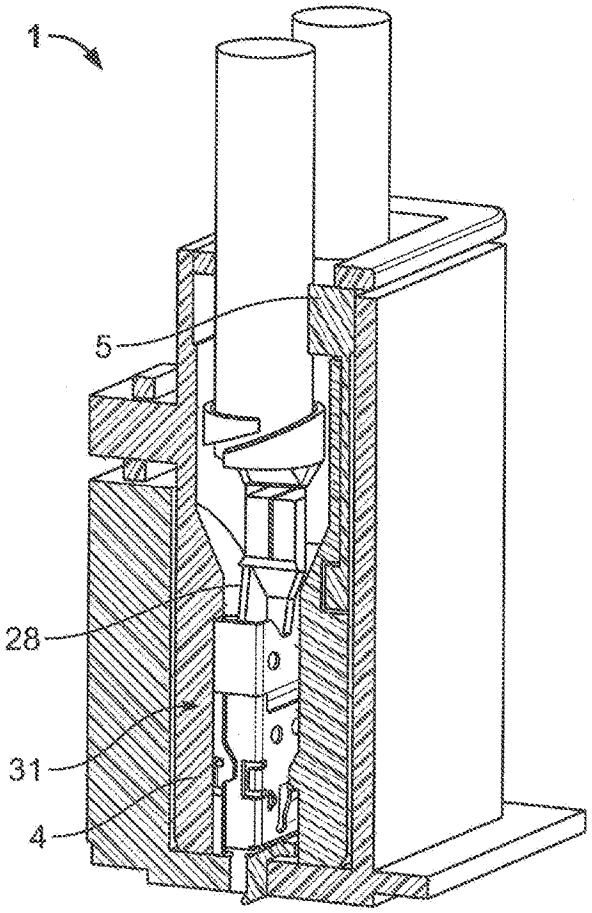
FIG. 8 is a sectional view of a section of the plug connector of FIG. 6 inserted into housing.
Figure 7:
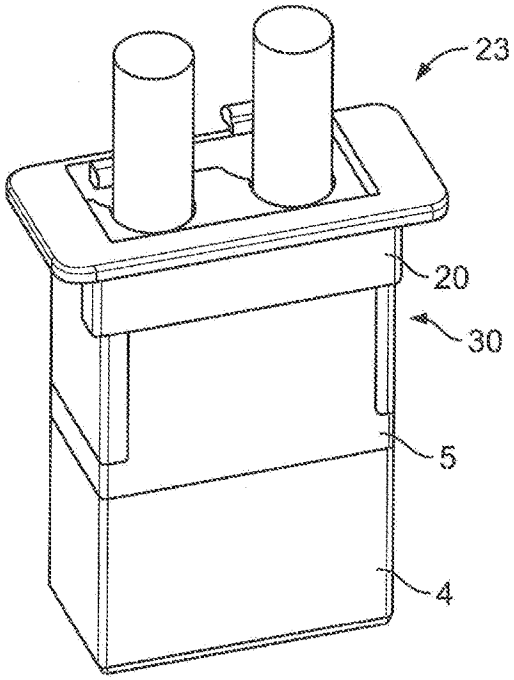
FIG. 7 is a perspective view of the pre-mounted connector assembly of FIG. 6.

In an embodiment of FIGS. 6-8, the cable collar 5 and the plug connector 4 assembled together form another plug connector unit 23. However, the cable collar 5 simultaneously also serves as a contact fuse by which contact elements 27 are positioned in a contact receiving chamber 28 of the plug connector 4.

The cable collar 5 locks into the plug connector 4 in two locking positions. In the assembly position 29 shown in FIG. 6, the contact chamber 28 is released for complete insertion of the contact element 27 by the cable collar 5.

In the second locking position, the operating position shown in FIG. 7, the contact elements 27 are directly or indirectly affixed in their final position by the cable collar 5. The cable collar 5 can only be transferred from the mounted position 29 into the operation position 30 when the contact elements 27 are in their final position 31 shown in FIG. 8. Before reaching the final position 31, the path of the cable collar 5 from the assembly position 29 to the operating position 30 is blocked directly or indirectly by the contact element 27. The cable collar 5 may thus serve as a connector position assurance plug ("CPA"). As with the exemplary embodiment of FIGS. 4 and 5, the plug connector unit 23 of the embodiment of FIGS. 6-8 also has a first guide member 20 that is accessible from outside, in particular a protruding first guide member 20, with which the cable collar 5 is supported in the plug connector receiving space 3.

In the above exemplary embodiments, the plug connector 4 is inserted into the plug connector receiving space 3 of the housing 2 from its cable receiving end to its plug end. However, in other embodiments the plug connector 4 is inserted into the housing 2 from the side. In this case, the housing 2 would be open on one side, from the attachment end 11 to the cable receiving end 10.

What is claimed is:

1. An electrical connector assembly comprising:

a housing having a cable receiving end and an opposing support facing end, a plug connector receiving space, and a flange positioned on the support facing end;

a plug connector positionable in the plug connector receiving space;

a cable collar positioned within the plug connector and having at least one cable receiving space; and at least one cable attached at an end to the plug connector and positioned in the cable receiving space, the at least one cable and the cable collar completely closing the cable receiving end of the housing.

2. The electrical connector assembly of claim 1, wherein the cable collar and the plug connector form a pre-assembled plug connector unit insertable into the housing.

3. The electrical connector assembly of claim 2, wherein the cable collar further comprises a first guide member.

4. The electrical connector assembly of claim 3, wherein the first guide member protrudes out of the plug connector when the cable collar is positioned within the plug connector.

5. The electrical connector assembly of claim 4, wherein the housing further comprises a second guide member that is complementary to the first guide member.

6. The electrical connector assembly of claim 5, wherein the first guide member engages with the second guide member when the pre-assembled plug connector unit is inserted into the housing.

7. The electrical connector assembly of claim 5, wherein the first and second guide members together form a linear guide to guide the cable collar into the plug connector receiving space along an insertion direction.

8. The electrical connector assembly of claim 1, wherein the cable collar forms a cable position assurance, the plug connector only being received in the plug connector receiving space when the cable collar has been inserted into the plug connector receiving space in a final position.

9. An electrical connector assembly comprising:

a housing having a cable receiving end and an opposing support facing end, a plug connector receiving space, and a flange positioned on the support facing end;

a plug connector positionable in the plug connector receiving space;

a cable collar positioned within the plug connector and having at least one cable receiving space, the cable collar and the plug connector forming a pre-assembled plug connector unit insertable into the housing, the cable collar having a first guide member protruding out of the plug connector when the cable collar is positioned within the plug connector and the housing having a second guide member complementary to the first guide member, the first and second guide members together forming a linear guide to guide the cable collar into the plug connector receiving space along an insertion direction; and at least one cable attached at an end to the plug connector and positioned in the cable receiving space.

10. The electrical connector assembly of claim 9, wherein the first guide member engages with the second guide member when the pre-assembled plug connector unit is inserted into the housing.

11. The electrical connector assembly of claim 9, wherein the cable collar forms a cable position assurance, the plug connector only being received in the plug connector receiving space when the cable collar has been inserted into the plug connector receiving space in a final position.

* * * * *